US005823091A

United States Patent [19]

Collingborn

[11] Patent Number: 5,823,091

[45] Date of Patent: Oct. 20, 1998

[54] RADIAL PISTON PUMP HAVING MEANS FOR SELECTIVELY DISABLING AT LEAST ONE OF THE PUMPING CHAMBERS

[75] Inventor: Peter Collingborn, Gillingham, England

[73] Assignee: Lucas Industries, Plc, Solihull, England

[21] Appl. No.: 863,072

[22] Filed: May 23, 1997

[30] Foreign Application Priority Data

May 23, 1996 [GB] United Kingdom ..... 9610785

[51] Int. Cl.[6] ..... F01B 29/04

[52] U.S. Cl. ..... 92/59; 92/72; 92/128; 92/129; 417/238; 417/470

[58] Field of Search ..... 92/59, 72, 129, 92/128; 417/238, 470

[56] References Cited

U.S. PATENT DOCUMENTS

| | | | |
|---|---|---|---|
| 2,941,475 | 6/1960 | Blair | 417/238 |
| 3,178,888 | 4/1965 | Hampton | 417/238 |
| 3,682,565 | 8/1972 | Yarger | 417/270 |
| 4,482,300 | 11/1984 | Brown | 417/239 |
| 4,615,258 | 10/1986 | Hirmann | 92/129 |
| 4,702,680 | 10/1987 | Bohringer et al. | 417/490 |

*Primary Examiner*—Thomas E. Denion
*Attorney, Agent, or Firm*—David P. Gordon; David S. Jacobson; Thomas A. Gallagher

[57] ABSTRACT

The present invention relates to a radial piston pump, and more particularly to a radial piston pump suitable for delivering liquid at a high pressure and at a volumetric output rate which can be controlled independently of the speed of rotation of the pump drive shaft. A radial piston pump(1) is provided which comprises a multiplicity of radially extending cylinders(14) each of which is provided with a radially moveable pumping plunger(15) to define, within the cylinder, a pumping chamber(16) which may be increased in volume by a movement of its associated plunger(15) in one direction to receive a liquid to be pumped and may be reduced in volume by movement of its associated plunger (15) in the opposite direction to deliver a liquid at high pressure to an output line. The pump(1) also comprises means for selectively disabling one or more of the pumping chambers(16) so that the or each disabled pumping chamber delivers no pumped fluid to the output line. The arrangement of the present invention has the advantage over the prior art of providing a reduction in the variation of drive torque.

14 Claims, 4 Drawing Sheets

RADIAL PISTON PUMP HAVING MEANS FOR SELECTIVELY DISABLING AT LEAST ONE OF THE PUMPING CHAMBERS

BACKGROUND OF THE INVENTION

1. Field of the Invention

This invention relates to a radial piston pump, and more particularly to a radial piston pump suitable for delivering liquid at a high pressure and at a volumetric output rate which can be controlled independently of the speed of rotation of the pump drive shaft.

An embodiment of the invention is particularly suitable for use as a fuel supply pump to supply high pressure fuel to an accumulator or directly to the common rail of a common rail fuel injection system for an internal combustion engine.

2. State of the Art

Known radial piston pumps for fuel injection systems have a number of disadvantages if used to supply high pressure fuel to an accumulator or directly to the common rail of a common rail fuel injection system. In order to provide output at a rate which is as constant as possible under full load conditions a radial piston pump preferably comprises a multiplicity of long stroke pumping plungers which are operated by a common eccentric. For example, a radial piston pump with three pumping plungers located at 120° intervals relative to each other and driven by a common eccentric will deliver fuel at a combined rate which varies by about ±7% from a steady value when operating at full stroke. The drive torque necessary to drive the plungers similarly varies by a relatively small percentage from a steady value. If a relatively lower volumetric rate of delivery for the same drive shaft rotational speed is required excess pumped fuel can be spilled through an appropriate spill valve. However, this procedure leads to a considerable wastage of energy. As an alternative, the inlets to the pumping chambers can be controlled so that the pumping chambers only partially fill during each fill stroke with the result that the pumped volume corresponds with the required output. However, with such a procedure the start of pumping for each plunger is retarded relative to the start point at full stroke and the combined rate output of the plungers, and the corresponding drive torque requirement, changes from the relatively smooth characteristic at full output to a progressively more saw-tooth-like shape as the controlled output reduces. The increasingly uneven output flow rate and drive torque requirement are both highly undesirable.

SUMMARY OF THE INVENTION

According to one aspect of the present invention there is provided a radial piston pump comprising a multiplicity of radially extending cylinders each of which is provided with a radially movable pumping plunger to define, within the cylinder, a pumping chamber which may be increased in volume by a movement of its associated plunger in one direction to receive a liquid to be pumped and may be reduced in volume by movement of its associated plunger in the opposite direction to deliver liquid at high pressure to an output line, the pump comprising means for selectively disabling one or more pumping chambers so that the or each disabled pumping chamber delivers no pumped fluid to the output line.

By selectively disabling one or more pumping chambers under certain operating conditions, the remaining pumping chambers continue to operate over a relatively large part of their stroke, as compared with the part of their stroke over which they would operate if all the pumping chambers were contributing to the particular level of volumetric output. This leads to a reduction in the variation of torque required to drive the pump. Disabling of one or more pumping chambers is preferably achieved by preventing the flow of liquid into the pumping chamber during what would normally be the filling stroke of the associated plunger. By this means, the pump plungers of the disabled pumping chambers will remain stationary at the position corresponding to the end of their pumping stroke when their associated pumping chamber is disabled.

In a particularly preferred embodiment of the invention the pump is provided with six identical pumping chambers spaced apart circumferentially by 60° and driven by a common eccentric. Under full load conditions each pumping chamber is fully charged during each stroke of its associated plunger. As the required delivery volume progressively decreases from full load conditions the inlet to three of the pumping chambers, spaced 120° from each other, is progressively decreased whilst the remaining three pumping chambers continue to operate at full volume. When half load conditions are reached the delivery to the three controlled pump chambers will have been restricted to nothing and the entire delivery will be provided by the remaining three pumping chambers.

A further problem associated with radial piston pumps operating at high pressures is that if a simple cam and cam follower arrangement is used for driving the pump plungers it become progressively more difficult to maintain adequate lubrication as delivery pressure increases. The higher the delivery pressure, the greater will be the force which the cam must exert and the greater will be the tendency for lubricating oil to be squeezed out from the interface between the cam and its follower or between the roller and shoe of the cam followers as the case may be.

According to another aspect of the present invention a radial piston pump comprising a multiplicity of radially extending cylinders each of which houses a pump plunger which is driven by an eccentric provided on a drive shaft is provided with a block rotatably mounted on the eccentric and having a face corresponding to each of the cylinders; a tappet associated with each pump plunger, each tappet presenting a face to one of the faces of the block; and rotatable bearing elements inter-posed between each block face and its corresponding tappet face to support the tappet for transverse movement relative to its associated face of the block during operation of the pump.

The rotatable bearing elements are preferably needle rollers mounted in a roller cage.

Preferably, the block is mounted on the eccentric by way of rotatable bearing elements, for example needle roller bearings.

According to a third aspect of the present invention the pumping chamber of a high pressure pump is closed by a means of a tapered plug which is located in a matching taper of a tapered region of a passage leading to the pumping chamber, the tapered plug being, in use, secured in position by a screw plug which is screw-threadedly engaged with screw threads provided in a portion of the passage located outwardly of the taped region.

Preferably, the taper plug includes a passage which extends from a port which opens into the pumping chamber to a valve seat provided on the taper plug, and a valve element is biased into contact with the valve seat to provide a non-return valve permitting passage of liquid from the pumping chamber to an outlet connection down stream of the valve element. Preferably, the valve element is located in a bore in the taper plug which is closed to the exterior of the pump by the screw plug. Preferably, a washer is located between the screw plug and the taper plug to seal the valve member bore.

With such an arrangement, an outlet valve to the pumping chamber can be provided within the tapered plug and the sealing of the pumping chamber to the exterior of the pump is effected by the taper between the taper plug and the tapered region of the passage in combination with a washer which is compressed between the screw plug and the taper plug. Such an arrangement provides particularly simple and effective sealing of the pumping chamber and facilitates ready access to the valve member for service purposes. The arrangement also provides an outlet valve arrangement which offers a very low level of dead volume in tile pumping chamber.

The above and further features of the advantage of the present invention become clear from the following description of a preferred embodiment thereof given by way of example only, reference being had to the accompanying drawings.

DETAILED DESCRIPTION OF THE PREFERRED EMBODIMENTS

Figure 1:
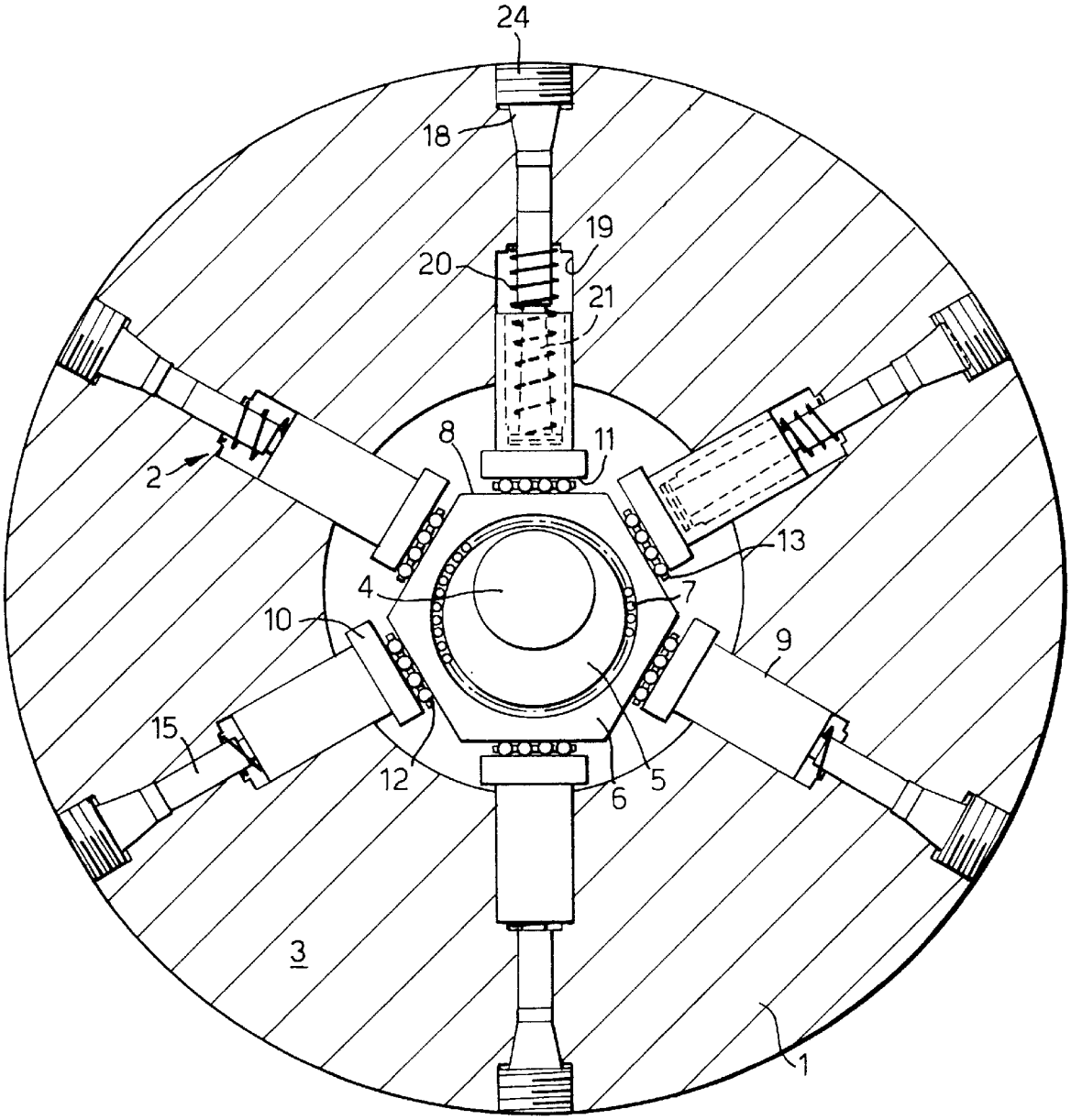
FIG. 1 is a schematic cross-sectional view through a preferred embodiment of radial piston pump according to the present invention.

Referring firstly to FIG. 1 there is shown schematically in transverse cross-section a radial piston pump 1 for delivering fuel at high pressure to an output line for supplying an accumulator or the common rail of a common rail fuel injection system of an internal combustion engine. The pump 1 comprises six identical pumping sections 2. A single pumping section 2 is shown in greater detail in FIG. 2. The pumping sections 2 are located in a common body 3 in which is mounted a drive shaft 4 carrying an eccentric 5. A block 6 is mounted on the eccentric 5 by way of needle roller bearings 7. The block 6 presents a respective flat face 8 to each pumping section 2. Each pumping section 2 incorporates a tappet 9 having a tappet foot 10 which presents a flat face 11 to its associated block face 8. A multiplicity of needle rollers 12 are mounted between each tappet foot face 11 and its associated block face S. Each set of needle roller 12 is mounted in a cage 13 and is located between lips provided on the edges of the tappet feet 10 and static guide plates provided at opposite ends of the block 6.

The needle rollers 12 are effective to transfer forces perpendicular to the faces 8, 11 from the block to the tappets 9. However, because the rollers are in rolling contact with both the block face 8 and the tappet face 11, they do not transfer forces between the block 6 and the tappets 9 which are transverse to the axes of the tappets.

If desired, the needle rollers may be mounted in retaining grooves in the block face or tappet faces rather than being mounted in the cage between the faces. However, if the needle rollers are located in grooves they will experience some sliding friction which does not occur when the needle rollers operate between flat faces as illustrated in FIG. 1. Accordingly, the arrangement of FIG. 1 is preferred.

Figure 2:
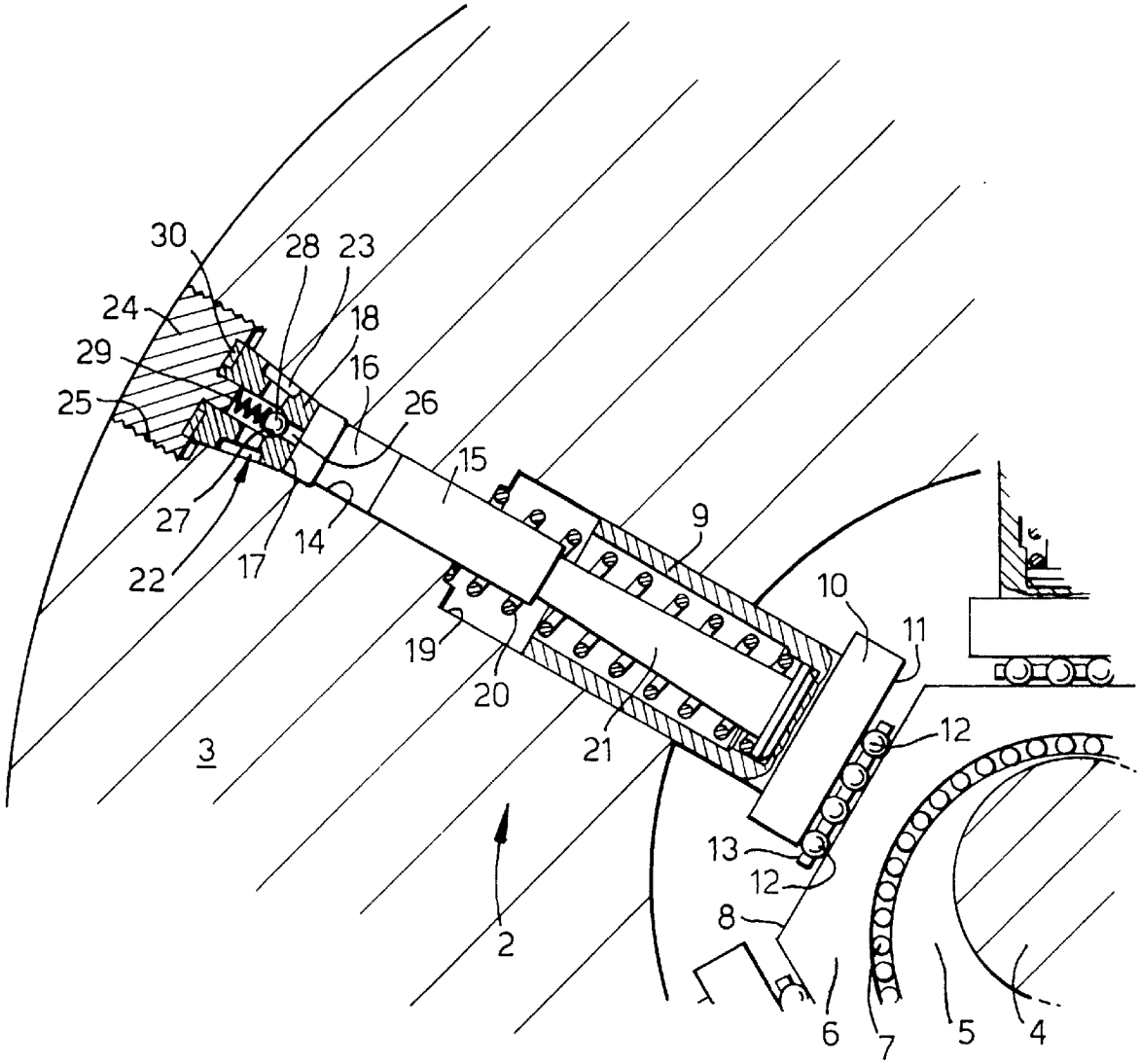
FIG. 2 is an enlarged view of one of the pumping sections of the pump of FIG. 1.

Referring now to FIG. 2, one pumping section 2 is illustrated in detail. The pumping section 2 includes a cylinder 14 defined in the body 3 and an associated pump plunger 15 which is slidably mounted in the cylinder 14 to define a pumping chamber 16 located between the plunger 15 and the axially inner face 17 of a taper plug 18 which closes the radially out end of the cylinder 14. Each plunger 15 has associated with it a tappet 9 which is slidably mounted in a guide bore 19 provided in the body 3. The tappets 9 are each biased radially inwardly by a tappet spring 20. A tappet peg 21 is located within each tappet 9 by the tappet spring 20 and abuts its associated plunger 15 such that when the tappets 9 are driven radially outwardly by the eccentric 5 each tappet peg 21 drives its associated plunger 15 radially outwardly to reduce the volume of the pumping chamber 16 and deliver liquid via a non-return valve 22 provided in the taper plug 18 to an output line.

When the above described pump is required to operate at maximum output volume each pumping chamber 16 is fully charged during each radially inward movement of its associated plunger 15 via a suitable filling line (not shown). Accordingly, at the commencement of each pumping stroke each respective plunger is at its radially innermost position and movement of the plunger from that position to its radially outermost position during its pumping stroke will deliver the maximum available volume to the output line. In order to reduce the volumetric output of the pump (for a given speed of drive shaft rotation) as compared with the maximum available, control means are provided for disabling some of the pumping chambers and for controlling the volume of fuel delivered during each pumping stroke by the remaining pumping chambers. In the preferred embodiment of the invention, in which there are six pumping sections, control means are provided for simultaneously disabling three of the pumping sections (located at 120° relative to each other) and for controlling the output of the other pumping sections. In an alternative embodiment, in addition to means for disabling one set of pumping chambers, means may be provided for controlling the output of those pumping chambers. However, since simply disabling one or more pumping chambers and controlling the pumping volume of the remaining pumping chambers is relatively simple compared with controlling the volumetric output of all pumping chambers as well as disabling some of them, the former arrangement is preferred.

To this end, in the preferred embodiment, means are provided for selectively preventing the flow of filling liquid to one set of three pumping chambers (located at 120° relative to each other) and for controlling the effective pumping volume of the remaining chambers. The effective pumping volume of the remaining chambers may be controlled either by controlling the supply of fluid to those chambers during the respective filling strokes thereof, or by spilling high pressure fluid from those chambers during delivery stroke of the associated plungers. Either arrangement provides significant improvements as compared with the prior art.

If the pump is considered to be operating at full output so that all pumping chambers are delivering the maximum available volume, and it is desired to reduce the volumetric output of the pump, the three chambers which can be disabled are, initially, permitted to continue pumping at full volumetric output whilst the remaining three chambers are controlled to progressively reduce the output volume from those chambers. By this means, the total output of the pump may be reduced from 100% to 50% by reducing the output for the controllable pumping chambers from 100% to 0%. If the total output of the pump is to be reduced to less than 50% of the maximum output of the pump the chambers which can be disabled are disabled, and the volumetric output of the chambers which can be controlled is progressively reduced from 100% to 0% in order to reduce the total pump output from 50% to 0%.

Figure 3A:
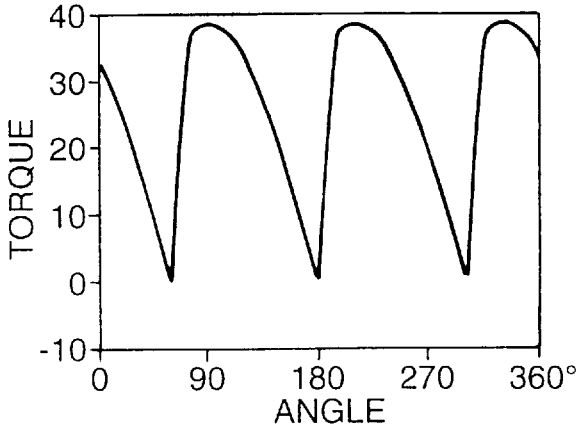
FIGS. 3A, 3B and 3C show respectively the torque required to drive a pump having three large pump plungers at 75% output, 50% output and 25% output.
Figure 3B:
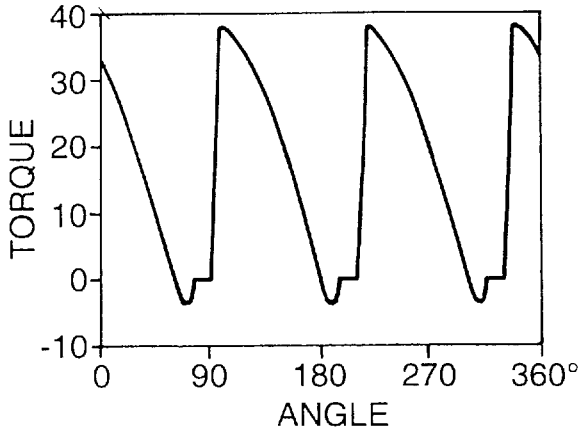
Figure 3C:
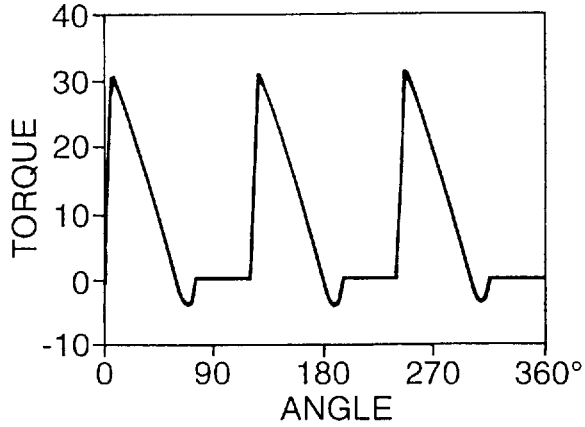

For a full understanding of the present invention reference should be had to FIGS. 3A, 3B and 3C and 4A, 4B and 4C which show the total torque requirement for pumps having three large plungers (FIGS. 3A, 3B and 3C) and six small plungers (4A, 4B and 4C) operating at respectively 75% output (FIGS. 3A and 4A), 50% output (FIGS. 3B and 4B) and 25% output (3C and 4C). The cross-sectional area of the individual plungers of the pump of FIGS. 3A, 3B and 3C is twice that of the individual plungers of the pump of FIGS. 4A, 4B and 4C and accordingly the two pumps have the same total available maximum output volume (assuming the same plunger stroke and rotational speed).

Figure 4A:
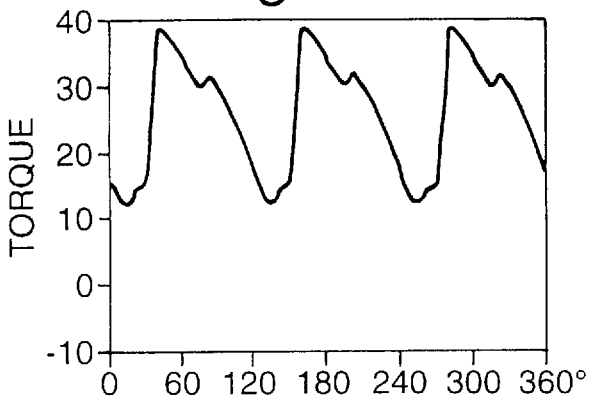
FIGS. 4A, 4B and 4C show respectively the torque required to drive a pump having six small pump plungers and a control arrangement in accordance with the present invention at 75% output, 50% output and 25% output.

Looking firstly at FIGS. 3A and 4A, when a pump having three large plungers is operated by throttling the filling of each pumping chamber to provide a total output equal to 75% maximum, the required torque to drive the pump has a pronounced saw-tooth profile and varies from 0 to nearly 40 Nm three times during each rotation of the shaft. To achieve the same level of output (75%) in the case of the present invention three of the pumping chambers will continue to operate at their full volume, whilst the remaining three will operate at half their available volume. This will produce the required torque levels illustrated in FIGS. 4A. It will be noted that the torque has a less pronounced saw-tooth profile and that the torque level required remains positive and varies from just above 10 Nm to just below 40 Nm.

Figure 4B:
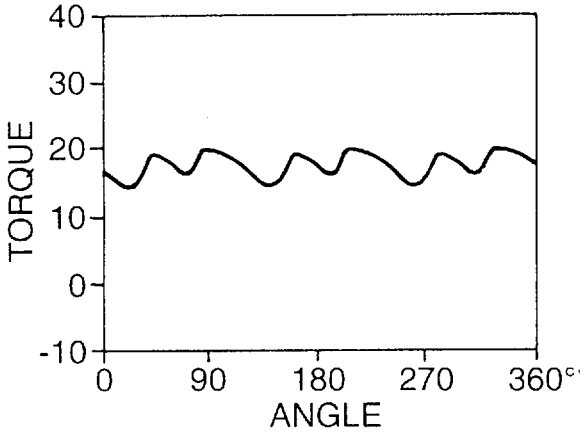

Looking now at FIGS. 3B and 4B, the combined torque at a total of 50% output is shown. In the case of a three plunger pump each pumping chamber is charged to half its available volume during the filling stroke and the total combined operating torque required is shown in FIG. 3B. In the case of the embodiment of the present invention three of the pumping chambers will continue to be charged to their maximum available volume whilst three of the pumping chambers will not be charged at all. This gives rise to the combined torque requirement illustrated in FIG. 4B. It will be noted that FIG. 4B represents a dramatically better torque characteristic than FIG. 3B.

Figure 4C:
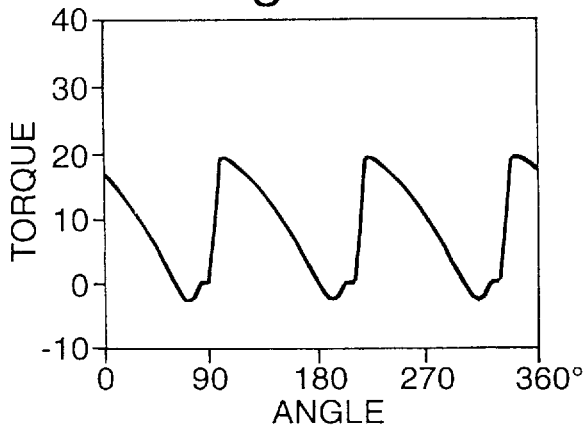

Finally, considering FIGS. 3C and 4C the combined torque requirements for a pump operating at 25% total output is shown. In the case of a three plunger pump a very pronounced saw-tooth profile is required with substantially no torque required during a substantial proportion of each rotation of the shaft, and the maximum torque required still being in excess of 30 Nm. Note also the rapid rise from zero to maximum torque. In contrast, in the arrangement of the present invention in which, to deliver 25% output, three of the pumping chambers are disabled and the remaining three pumping chambers operating at 50% volume, the required driving torque is as shown in FIG. 4C. Comparing FIGS. 3C and 4C it will be noted that the proportion of each revolution during which no torque is required is much smaller in the case of the present invention, and the total maximum torque required in the case of the embodiment of the present invention is slightly less than 20 Nm as compared with slightly more than 30 Nm in the case of the prior art.

Referring again to FIG. 2 the pumping chamber 16 are closed by a particularly desirable sealing arrangement which also provides for particularly desirable housing of the non-return valve 22 in a manner which gives rise to a minimum of dead volume within the pumping chamber.

Each pumping chamber 16 is closed by a taper plug 18 which is driven into sealing engagement with a mating taper 23 by means of a screw plug 24 which is in screw threaded engagement with a threaded bore 25 provided in the body 3. An axial bore 26 extends from the end face 17 of the taper plug 18 to a seat 27 of the non return valve 22. The valve member of the non return valve is constituted by a ball 28 which is located in a passage 29 which extends from the seat 27 to the radially outer end of the taper plug 18.

The ball 28 is biased against its associated seat 27 by a spring which reacts against a shoulder provided on the plug 24. A suitable washer, for example an iron washer 30, is provided between the screw plug 24 and the taper plug 18 to provide a fluid seal. Accordingly, sealing of the radially outer end of the pumping chamber 16 is effected by virtue of the taper fit of the plug 18 and the axial compression of the washer 30. Both the taper fit and the axial compression of the washer give rise to reliable fluid seals. Also, by positioning the non-return valve 30 in the tapered plug 18 a minimum of dead volume is provided upstream of the non return valve 22.

I claim:

1. A radial piston pump comprising:

a plurality of radially extending pumping plungers;

a plurality of radially extending cylinders, each of which is provided with an associated one of the plurality of plungers to define a pumping chamber which is increasable in volume by a movement of its associated plunger in a first direction to receive a liquid to be pumped, and is reducible in volume by movement of its associated plunger in a direction opposite said first direction to deliver liquid at high pressure to an output line; and means for selectively disabling at least one of the pumping chambers so that the at least one disabled pumping chamber delivers no pumped fluid to an output line.

2. A radial piston pump as claimed in claim 1, wherein the means for selectively disabling one or more of the pumping chambers comprises means for preventing the flow of liquid into the pumping chamber during movement of the associated plunger in the first direction.

3. A radial piston pump as claimed in claim 1, wherein six identical pumping chambers are spaced apart circumferentially by 60° and driven by a common eccentric.

4. A radial piston pump as claimed in claim 2, wherein:

six indentical pumping chambers are spaced apart circumferentially by 60° and driven by a common eccentric.

5. A radial piston pump comprising:

a plurality of radially extending pumping lungers;

a plurality of radially extending cylinders, each of which houses one of the plurality of pumping plungers;

an eccentric provided on a drive shaft which drives the plurality of pumping plungers;

a block rotatably mounted on the eccentric and having a plurality of block faces, one block face corresponding to each of the plurality of cylinders;

a tappet associated with each of the pumping plungers, each tappet presenting a tappet face to one of the block faces; and a plurality of rotatable bearing elements interposed between each block face and its corresponding tappet face to support the tappet for transverse movement relative to its associated block face during operation of the pump.

6. A radial piston pump as claimed in claim 5, wherein the rotatable bearing elements are needed rollers mounted in a roller cage.

7. A radial pump as claimed in claim 5, wherein the block is mounted on the eccentric by way of rotatable bearing elements.

8. A radial piston pump as claimed in claim 5, wherein:

said rotatable bearing elements are needle roller bearings.

9. A radial piston pump as claimed in claim 6, wherein the block is mounted on the eccentric by way of rotatable bearing elements.

10. A radial piston pump as claimed in claim 9, wherein:

said rotatable bearing elements are needle roller bearings.

11. A pump comprising a pump chamber closed by a taper plug which is located in a matching taper of tapered region of a passage leading to the pumping chamber so that an end of the taper plug defines a wall or wall portion of the pump chamber, the plug being, in use, secured in position by a screw plug which is screw-threadedly engaged with screw threads provided in a portion of the passage located outwardly of the tapered region.

12. A pump as claimed in claim 11, wherein the taper plug includes a passage which extends from a port which opens into the pumping chamber to a valve seat provided on the taper plug, and a valve element biased in contact with the valve seat to provide a non-return valve permitting passage of liquid from the pumping chamber to an outlet connection downstream of the valve element.

13. A pump as claimed in claim 12, wherein the valve element is located in a bore in the taper plug which is closed to the exterior of the pump by the screw plug.

14. A pump as claimed in claim 13, wherein a washer is located between the screw plug and the taper plug to provide a fluid seal.

* * * * *